343-756
12/22/81 XR 4,307,403

United States Patent [19]

Yamada et al.

[11] 4,307,403

[45] Dec. 22, 1981

[54] APERTURE ANTENNA HAVING THE IMPROVED CROSS-POLARIZATION PERFORMANCE

[75] Inventors: Yoshihide Yamada, Yokosuka; Takashi Yamada, Yokohama; Tadashi Takano, Yokosuka, all of Japan

[73] Assignee: Nippon Telegraph & Telephone Public Corp., Tokyo, Japan

[21] Appl. No.: 149,943

[22] Filed: May 15, 1980

[30] Foreign Application Priority Data

Jun. 26, 1979 [JP] Japan ..... 54-79673

[51] Int. Cl.[3] ..... H01Q 15/23; H01Q 15/24

[52] U.S. Cl. ..... 343/755; 343/756; 343/781 D; 343/914

[58] Field of Search ..... 343/756, 779, 840, 914, 343/753, 754, 755, 781 P, 912

[56] References Cited

U.S. PATENT DOCUMENTS

| | | | |
|---|---|---|---|
| 3,355,738 | 11/1967 | Algeo | 343/779 |
| 3,805,268 | 4/1974 | Britt | 343/756 |
| 4,109,253 | 8/1978 | Chu | 343/840 |

*Primary Examiner*—Eli Lieberman

*Attorney, Agent, or Firm*—Armstrong, Nikaido, Marmelstein & Kubovcik

[57] ABSTRACT

An aperture antenna having the improved phase performance of radiated co- and cross-polarization has been found. The present antenna has, at least, a horn for radiating an electro-magnetic wave, and means for focusing the electromagnetic wave. The focusing means is actually implemented by a reflector or a dielectric lens, and is designed so that the phase distribution of an electric field on an aperture plane of the focusing means has the period of $\pi/2$ and the maximum phase at $(2m-1)\pi/8$ from the reference plane of one polarized wave in the polar coordinates system on the aperture plane, where m is an integer.

9 Claims, 20 Drawing Figures

APERTURE ANTENNA HAVING THE IMPROVED CROSS-POLARIZATION PERFORMANCE

BACKGROUND OF THE INVENTION

The present invention relates to the improvement of an aperture antenna, in particular, relates to such an antenna with the improved crosspolarization discrimination. The present antenna can be utilized for a wireless communication system utilizing two polarizations, like a horizontally polarized wave, and a vertically polarized wave.

In a wireless communication system, two orthogonally polarized waves are frequently used for the efficient use of the limited frequency band. In this case, the system quality depends upon the interference between these two polarizations. The interference is increased when it rains, since the orientation polarization rotates by the rain drops and the orthogonality of the polarization is degraded. The other case of increasing the interference is when the fading occurs in the transmission route. In this case, the route of electro-magnetic wave from the transmitting antenna to the receiving antenna becomes multipath. By the difference of each path length of multipath and the characteristics of receiving antenna for the direction of multipath, the interference is increased.

FIG. 1 shows a prior aperture antenna which has been utilized in a microwave band. In the figure, the reference numeral 1 is a main reflector, 2 is a sub-reflector, 3 is a primary radiator which is implemented by a horn structure, 4*a* and 4*b* show the direction of the received electric wave, and 5 shows the center axis of the antenna beam. The numeral 6 is an aperture of an antenna, and 7 is the path of the electric wave from the horn 3 to the aperture 6.

When there is no fading, the direction (4*a*, 4*b*) of the received wave coincides with the center axis 5 of the antenna beam. However, when there is fading, the directions of the received wave are separated into $\phi_1$ and $\phi_2$ direction due to the multipath of the wave. And it should be noted that the phase of the wave received in one direction ($\phi_1$) is generally different from that in other direction ($\phi_2$).

FIGS. 2A and 2B show the antenna radiation characteristics of the amplitude and the phase respectively, where a solid line shows the characteristics of the co-polarization, and a dotted line shows the characteristics of the cross-polarization. As can be seen in FIG. 2A, the ratio of the co-polarization to the cross-polarization, or the discrimination of two waves, is larger than 45 dB, when there is no fading and the angle ($\phi$) is zero.

However, when there is fading, the phases of waves coming from $\phi_1$ and $\phi_2$ directions differ by 180 degree, so the amplitude of the co-polarization is considerably decreased, since two waves having the similar amplitude and the opposite phase are added with each other.

On the other hand, the amplitude of the cross-polarization is increased at the output of the antenna, since the phase of two cross-polarization become the same. The reason for that is as follows. Two cross-polarization from the direction $\phi_1$ and $\phi_2$ differs by 180 degrees in free space, the first cross-polarization from the direction $\phi_1$ has the phase rotation of 90 degrees at the antenna (see a dotted line in FIG. 2B), and the second cross-polarization from the direction $\phi_2$ has the phase rotation of $-90$ degrees at the antenna. Thus, the difference between phase rotations of two cross-polarization at the antenna is 180 degrees. Therefore, two waves having the opposite phases in the free space are rotated by 180 degrees by the antenna, then, the resultant phase between the two waves is 360 degrees which is equal to zero degrees.

As a result, when there is fading, the co-polarization is decreased and the cross-polarization is not decreased, and then, the ratio of the co-polarization to the cross-polarization becomes smaller than 45 dB. Therefore, the interference between co-polarization and the cross-polarization occurs. That interference between the co-polarization and the cross-polarization generates an undesirable problem to a microwave communication system which utilizes two polarization waves. However, there has been no effective proposal for decreasing the interference.

SUMMARY OF THE INVENTION

It is an object of the present invention, therefore, to overcome the disadvantages and limitations of a prior antenna by providing a new and improved antenna.

Another object of the present invention is to provide an antenna which has the high cross polarization discrimination by adjusting the phase of the cross-polarized radiated wave, even when there is fading.

The above and other objects are attained by an aperture antenna having a horn for radiating orthogonaly polarized electro-magnetic wave, means for providing a parallel beam from said electro-magnetic wave radiated by said horn, and said means for a parallel beam being so designed that the phase distribution of electric field on an antenna aperture plane has the period of $\pi/2$ and the maximum phase at $(2m-1)\ \pi/8$ from one reference polarization plane, where m is an integer.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

The theoretical principle of the present invention is first described for the easy understanding of the present invention. In the following analysis, a transmission antenna is analized although a reception antenna is discussed in the previous section, since the reciprocity theorem is applicable to an antenna.

Figure 3:
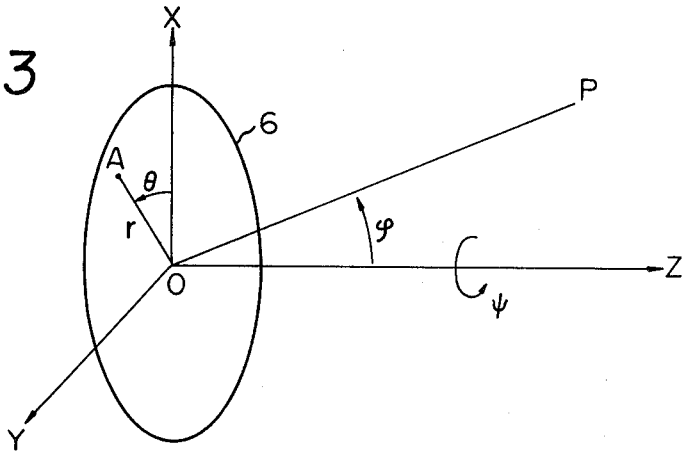
FIG. 3 shows the coordinates system for the explanation of the operation of the present antenna.

FIG. 3 shows the coordinates system showing the antenna aperture 6 and the direction of the radiated electric wave. The coordinates of the point A in the aperture plane 6 are shown by $(r,\theta,o)$, where r and $\theta$ are the coordinates in radial direction and in circumferential direction, respectively, in the cylindrical coordinates system, r is supposed to be normalized by the radius of the aperture. When the electric field at the point $(r,\theta,o)$ is $E_a$, the radiation field $E_r(\phi,\psi)$ is shown below.

$$E_r(\phi,\psi)=K\int_s E_a(r,\theta,o)e^{-jk\xi}ds \quad (1)$$

where $E_a$ and $E_r$ are complex numbers, k is the wave number, $\xi$ is the difference between the paths of the electro-magnetic waves, S is the area defined by the aperture, and K is a constant. Also, $\phi$ is the angle between the line OP and the z-axis, and $\psi$ is the rotation angle of the observation point P around the z-axis. It should be appreciated in the formula (1) that the radiation field $E_r$ is defined by the distribution of $E_a$, and can be adjusted by controlling the value $E_a$. The value $E_a$ can be expressed as shown in the formula (2), and the phase component of the formula (2) can be shown in the formula (3).

$$E_a=\perp E_a \perp e^{j\psi(r,\theta)} \quad (2)$$

$$\psi(r,\theta)=\Sigma a_n \cos(n\theta-\Theta_n) \quad (3)$$

where $\Theta_n$ is the angle for maximum deviation of the phase. It should be noted that for a prior aperture antenna the value $a_n$ is a constant, and n=0. By analyzing the antenna characteristics numerically, we found that the most important element which affects the phase characteristics shown in FIG. 2B is the distribution of $\psi(r,\theta)$. We also found that when n=2 and n=4, the change of the phase of the cross-polarization for the change of the radiation angle $\phi$ becomes smaller, and the range of $\phi$ which provides the opposite phases becomes smaller, thus, the discrimination of the co-polarization and the cross polarization is improved.

Figure 4A:
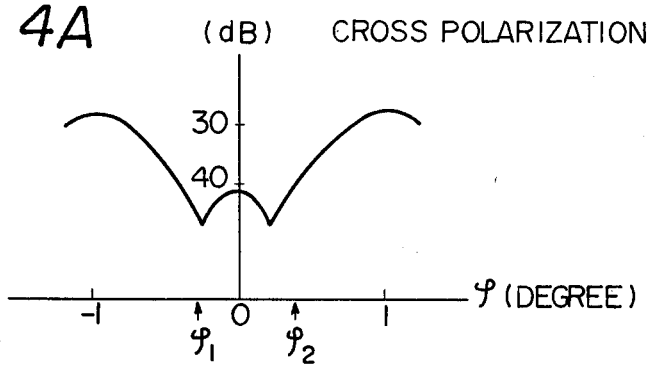
FIGS. 4A and 4B show the curves of the characteristics of the first embodiment of the present antenna.
Figure 4B:
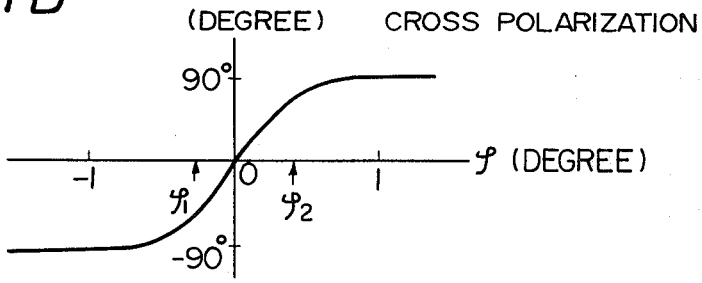

(1) In case of n=2;

In this case, the amplitude characteristics and the phase characteristics of the cross-polarization are shown in FIG. 4A and FIG. 4B, where $a_n$ and $\Theta_n$ are not zero. Comparing FIGS. 4A and 4B with FIGS. 2A and 2B, it should be noted that the phase difference between $\phi_1$ and $\phi_2$ in FIG. 4B is smaller than that of FIG. 2B, and therefore, FIG. 4B can improve the discrimination of the co- and cross-polarization when each polarization waves are received from $\phi_1$ direction and $\phi_2$ direction with opposite phase. However, FIG. 4A shows that the cross-polarization component for $\phi=\psi=0$ becomes higher than that of FIG. 2A, and the characteristics of FIG. 4A depends upon the value $a_n$. For instance, when the diameter of the aperture is 4 m, and the frequency is 6 GHz, $a_2$ is approximately 0.1 mm for obtaining the same discrimination of co- and cross-polarization shown in FIGS. 4A and 4B, therefore, an antenna reflector must be produced quite accurately. Accordingly, when n=2, although the characteristics of an antenna is improved, the discrimination of the two polarizations is perhaps not enough in practice.

(2) In case of n=4;

For various set of $a_n$ and $\Theta_n$, an antenna can have the various characteristics. Among them when $a_n=2r$ and $\Theta_4=\pi/2$, the phase distribution on the aperture is shown in the formula (4). Antenna characteristics depends little upon the value $a_n$, so $a_n=2r$ is taken as an example.

$$\psi(r,\theta)=2r\cos(4\theta-\pi/2) \quad (4)$$

Figure 5:
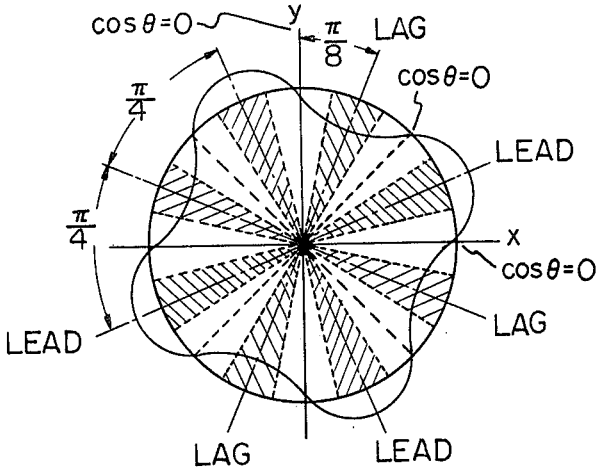
FIG. 5 shows the phase distribution on the plane of the aperture according to the present antenna.

FIG. 5 shows the phase distribution of the electric field on the plane of an antenna aperture according to the formula (4). FIG. 5 shows that the phase is lead for $0\leqq\theta\leqq\pi/4$, $\pi/2\leqq\theta\leqq\frac{3}{4}\pi$, $\pi\leqq\theta\leqq5/4\pi$ and $3/2\pi\leqq\theta\leqq7/4\pi$, and the phase is lag for other ranges of $\theta$. It should be also noted in FIG. 5, that the maximum lead phase or the maximum lag phase is obtained when $\theta=\pi/8$, $\frac{3}{8}\pi$, $\frac{5}{8}\pi$, $\frac{7}{8}\pi$, $9/8\pi$, $11/8\pi$, $13/8\pi$ and $15/8\pi$. In other words, the phase distribution in FIG. 5 has the period $\pi/2$ in the circumferential direction, and the maximum phase is obtained when the direction to the reference plane of polarization (horizontal plane or vertical plane) is $(2m-1)\pi/8$, where m is an integer.

Figure 6A:
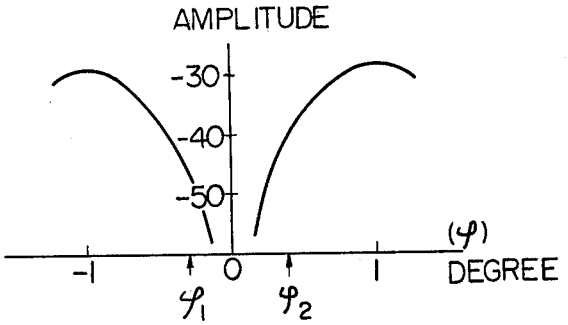
FIGS. 6A and 6B show the curves of the characteristics of the second embodiment of the present antenna.
Figure 6B:
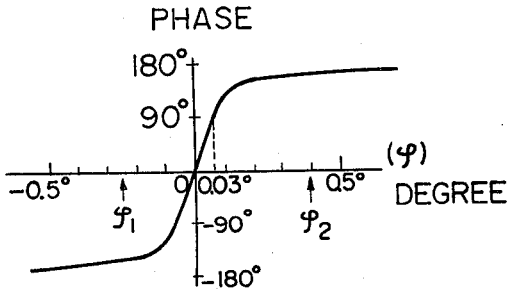

The radiation characteristics of the antenna for the cross-polarization are shown in FIGS. 6A and 6B, where FIG. 6A is the amplitude characteristics, and FIG. 6B is the phase characteristics. Comparing the amplitude characteristics of FIG. 6A with those of FIG. 2A, the level of cross-polarization is sufficiently small for $\phi=0$ in both cases, then, the discrimination of the co- and cross-polarization is enough when there is no fading.

When there is fading and the direction of the electromagnetic waves is separated into $\phi_1$ and $\phi_2$ directions according to FIG. 6B the wave from the direction $\phi_1$ has the phase rotation by +180 degrees, and the wave from the direction $\phi_1$ has the phase rotation by −180 degrees. Therefore, the phase difference between two waves is $(+180)-(-180)=360$. That is to say, the phase difference of two cross-polarized components at the antenna output is same as that in the free space. Also the phase difference of co-polarized components at the antenna output is same as that in the free space. So the level of the co-polarization is decreased due to the fading, the level of the cross polarization wave is also decreased, and the discrimination of the co- and cross-polarizations does not change.

Figure 1:
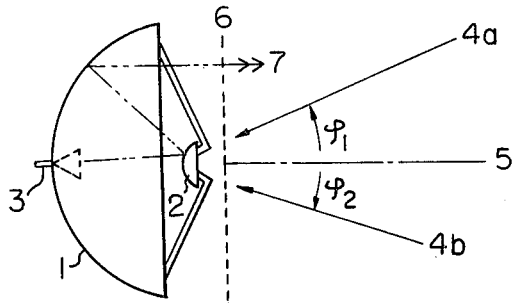
FIG. 1 shows the side view of a prior aperture antenna.
Figure 2A:
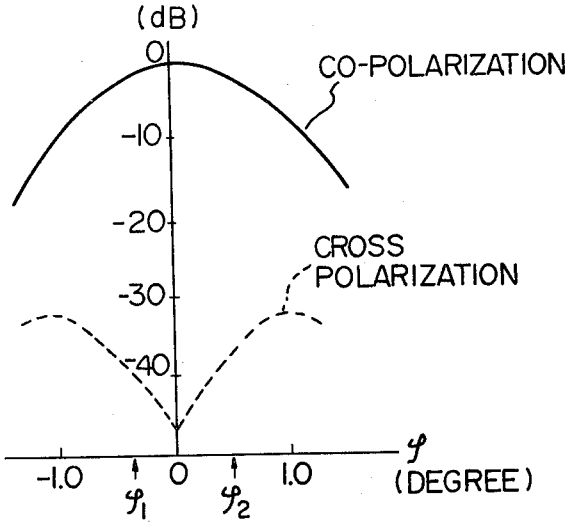
FIGS. 2A and 2B show the curves of the radiation characteristics of a prior aperture antenna.
Figure 2B:
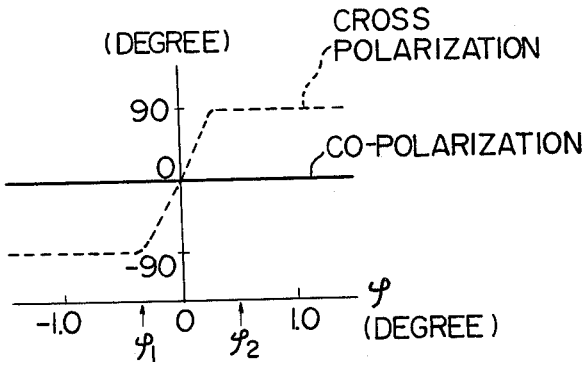

It should be noted that in a prior antenna having the characteristics of FIGS. 2A and 2B, in the case of fading the level of co-polarization is decreased and the level of cross-polarization is increased hence the discrimination between the co- and cross-polarization is greatly degraded.

As described above in detail, the discrimination characteristics of the two polarization is improved by providing the phase characteristics as shown in FIG. 5 and FIGS. 6A and 6B.

The structure of an antenna for implementing those phase characteristics will be described below.

Figure 7A:
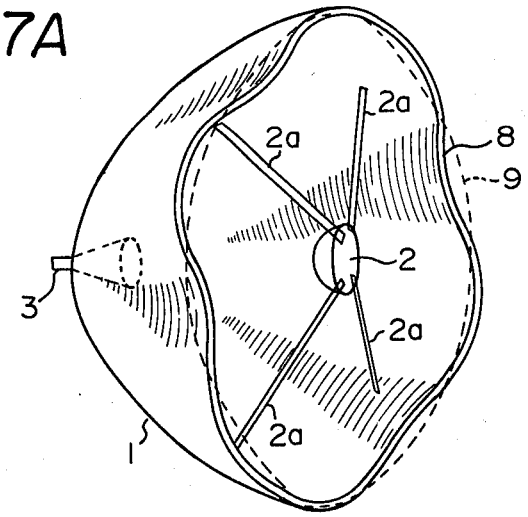
FIGS. 7A and 7B show the structure of the present antenna.
Figure 7B:
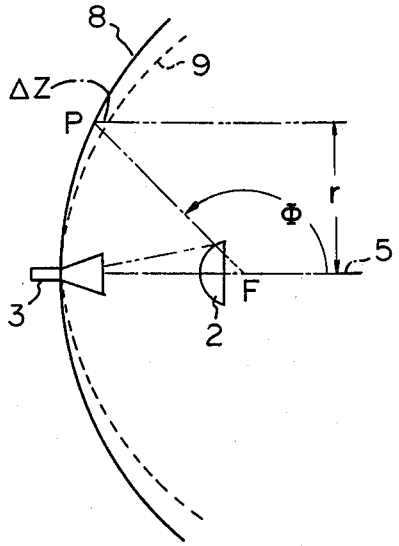

FIG. 7A is the perspective view of the axi-symmetrical aperture antenna according to the present invention, and FIG. 7B is the cross sectional view of the antenna shown in FIG. 7A. The principle concept of the antenna shown in FIGS. 7A and 7B is to adjust the length of the path of the electro-magnetic wave between the horn 3 and the aperture plane 6 so that the phase distribution shown in FIG. 5 is obtained. In the embodiment of FIGS. 7A and 7B, the shape of the reflector 1 is deformed depending upon the angle $\theta$. In FIGS. 7A and 7B, the reference numeral 2*a* is a support of the sub-reflector 2, 8 is the deformed reflector, and 9 is a prior reflector which is shown for the sake of comparison with the deformed reflector 8. The deformation $\Delta Z$ at the point $P(r,\theta,z)$ for providing the phase distribution of the formula (4) is shown below $$\Delta Z(1-\cos\phi)=2r\cos(4\theta-\pi/2) \quad (5)$$

where $\phi$ is the angle between the z-axis and the line FP where F is the focal point of the antenna.

Figure 8:
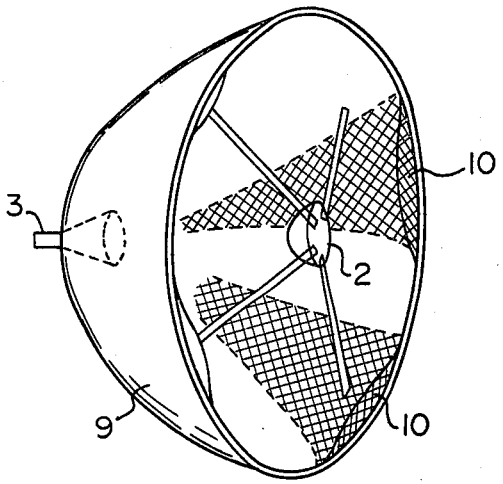
FIG. 8 shows the structure of another embodiment of the present antenna.

FIG. 8 shows another embodiment of the antenna according to the present invention, in which a dielectric structure 10 is mounted in the path of the electro-magnetic wave, and the thickness of the dielectric structure depends upon the angle $\theta$. In the embodiment of FIG. 8, the dielectric structure 10 is settled on the inner surface of a prior reflector 9. In this case, in order to satisfy the relations shown in the formula (4), the following formula (6) must be satisfied, where $\Delta t_1$ is the deviation of the thickness of the dielectric structure and $\epsilon$ is the dielectric constant.

$$\Delta t_1 \cdot \left( \frac{\epsilon}{\sqrt{\epsilon - \sin^2\phi}} + \frac{1}{\cos\phi} \right) = r\cos\left(4\theta - \frac{\pi}{2}\right) \quad (6)$$

Figure 9:
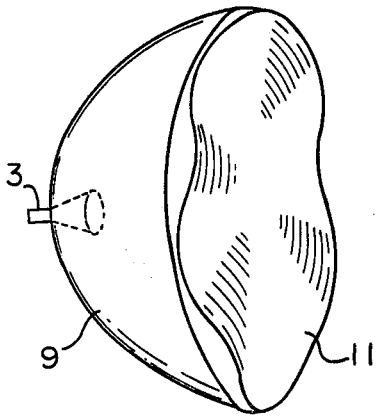
FIG. 9 shows the structure of another embodiment of the present antenna.

FIG. 9 shows another embodiment of the present antenna, in which a dielectric plate 11 is mounted on the plane of the antenna aperture for providing the phase distribution shown in FIG. 5. The embodiment of FIG. 9 has the advantage that a prior undeformed reflector is available without changing the shape. In order to satisfy the formula (4), the deviation of the thickness $\Delta t_2$ of the dielectric plate must satisfy the following formula (7).

$$\Delta t_2 \left( \frac{1}{\sqrt{\epsilon}} - 1 \right) = r\cos\left(4\theta - \frac{\pi}{2}\right) \quad (7)$$

Figure 10:
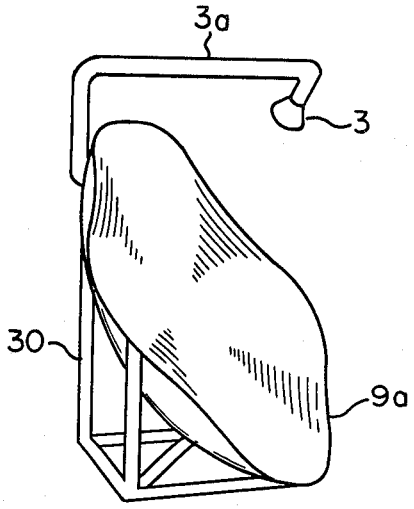
FIG. 10 is the structure of another embodiment of the present antenna.

FIG. 10 shows another embodiment of the present antenna, in which 3 is a horn, 3*a* is a wave guide for supplying a signal to the horn, 9*a* is a deformed reflector and 30 is a support. The embodiment of FIG. 10 is a so-called offset antenna, in which a horn 3 is positioned outside the path of the electric beam, thus, the characteristics of the antenna improved.

Figure 11:
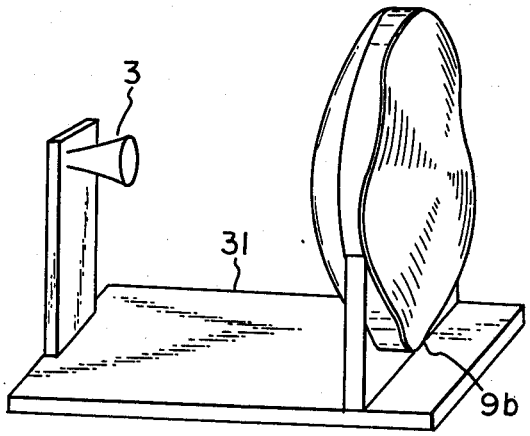
FIG. 11 is the structure of another embodiment of the present antenna.

FIG. 11 shows the another embodiment of the present antenna, which is a dielectric lens antenna. In the figure, the reference numeral 3 is a horn, and 9*b* is a dielectric lens, the thickness of each portion of the same is determined so that the beam radiated by the horn 3 is converted to a parallel beam, and the phase of that beam satisfies the relations shown in FIG. 5. The horn 3 and the lens 9*b* are mounted on the support 31.

Figure 12A:
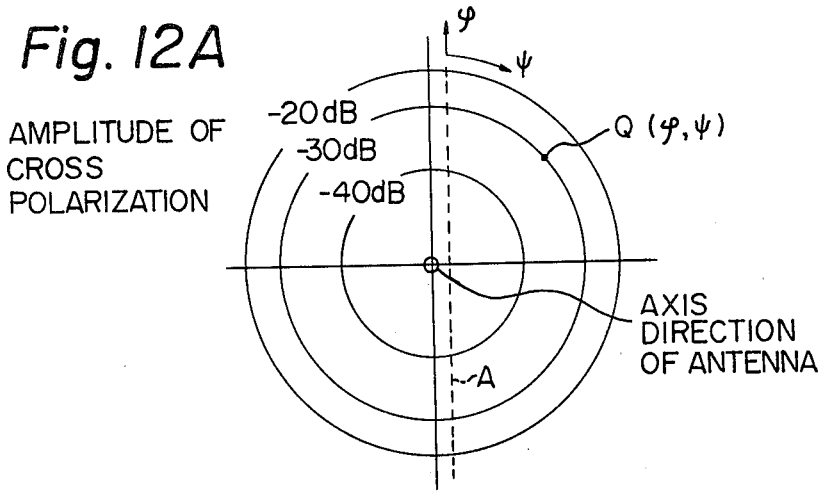
FIG. 12A and 12B show the curves of the characteristics in the whole direction according to the present antenna.
Figure 12B:
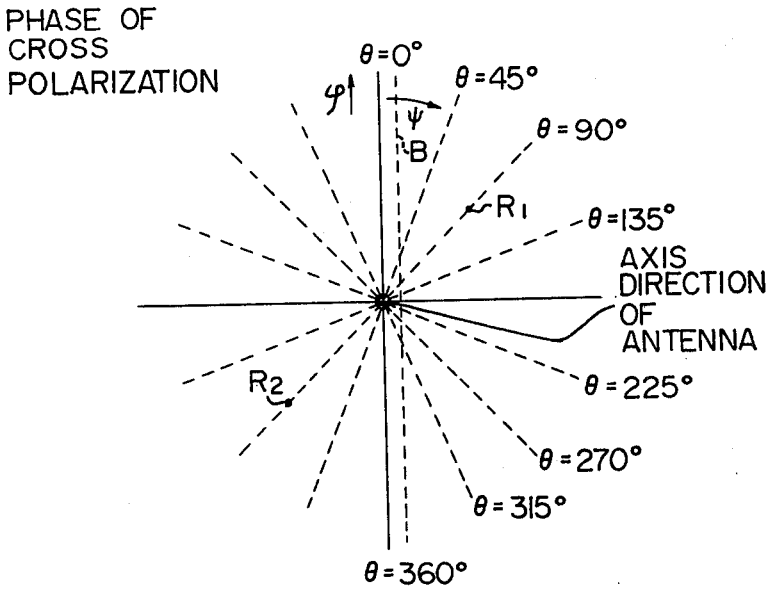

FIGS. 12A and 12B show the contour of the radiation characteristics of the present antenna in whole $(\phi,\psi)$ directions, in which FIG. 12A shows the amplitude characteristics of the cross polarization wave of the present antenna, and FIG. 12B shows the phase characteristics of the cross polarization wave of the present antenna. The locus of the equal amplitude of the cross-polarization wave is shown by the concentric circles around the antenna axis as shown in FIG. 12A, and the locus of the equal phase of the cross polarization wave is shown by the radial lines as shown in FIG. 12B.

It should be appreciated that the characteristics of FIGS. 6A and 6B are the particular cases of FIGS. 12A and 12B, and FIGS. 6A and 6B are the characteristics on the dotted lines A and B of FIGS. 12A and 12B, where the value of $\psi$ is very small. The radiation characteristics as shown in FIGS. 12A and 12B have not been obtained in a prior antenna.

Now, the experimental result of the present invention is described below.

Figure 13:
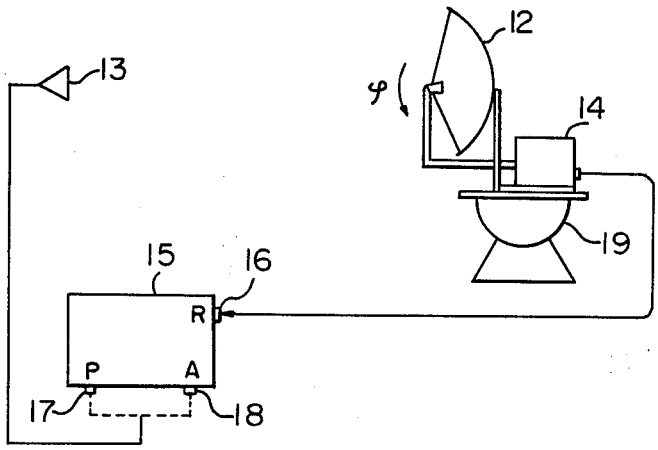
FIG. 13 shows the configuration of the experimental system of the present antenna.
Figure 14:
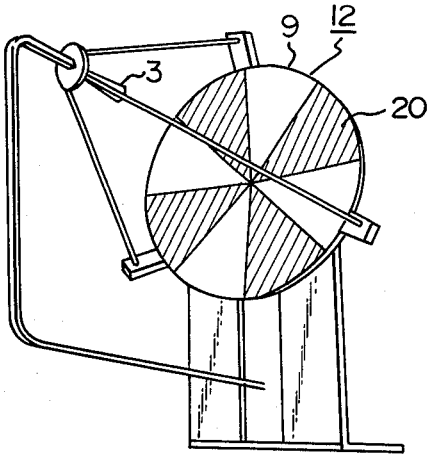
FIG. 14 shows the structure of the experimental antenna.

FIG. 13 shows the experimental system, and the reference numeral 12 is the antenna to be tested, 13 is the detecting antenna, 14 is a transmitter, 15 is a receiver, 16 is the input terminal of the reference signal, 17 is the input terminal for the phase information, 18 is the input terminal for the amplitude information, and 19 is the rotational stage. The structure of the experimental antenna 12 is shown in FIG. 14, in which a plurality of sector formed convexes 20 are attached on the surface of the undeformed reflector 9 so that the period of the convexes is $\pi/2$, instead of deforming the reflector itself.

In FIG. 13, the output power of the transmitter 14 is radiated through the test antenna 12 in the direction defined by the rotational stage 19. When the phase characteristics are measured, the output of the reference antenna 13 is applied to the phase input terminal 17 of the receiver 15. When the test antenna 12 is rotated on the stage 19, the phase of the signal received by the reference antenna 13 changes depending upon the phase characteristics of the test antenna 12, but the phase of the reference signal at the terminal 16 does not change. Therefore, by obtaining the difference of the phases between the terminal 16 and the terminal 17, the phase characteristics of the test antenna 12 is measured. When the amplitude characteristics are measured, the output of the reference antenna 13 is connected to the amplitude input terminal 18 of the receiver, and the received power is measured for each rotational angle of the test antenna 12.

Figure 15:
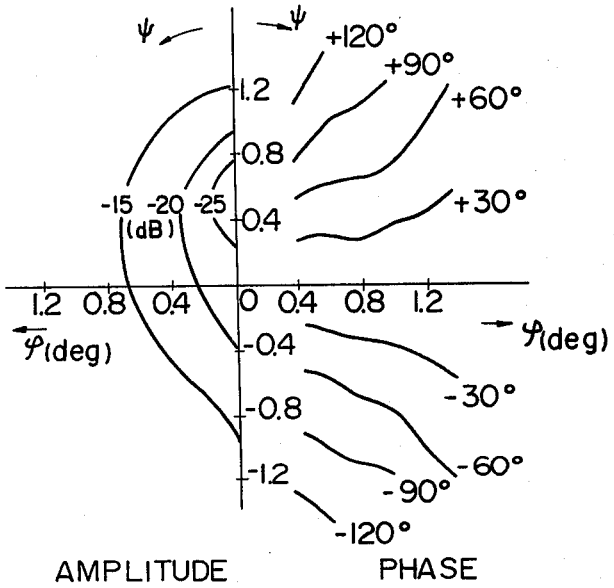
FIG. 15 shows the curves of the experimental result of the present antenna.

FIG. 15 shows the measured result of the present antenna, in which the left portion shows the amplitude characteristics, and the right portion shows the phase characteristics. Those characteristics correspond to those of FIGS. 12A and 12B, and it should be appreciated that the measured result coincides as a whole with the calculated value, except that the amplitude level of the measured value is higher than that of the calculated one due to the error of the deformation of the reflector.

As described above in detail, the present antenna can improve the phase characteristics of the cross polarized wave. Then, the improved wireless communication utilizing two polarization can be obtained, even when there is fading.

Further, it should be noted that the present antenna can provide the direction of the electro-magnetic wave by measuring the ratio and the phase difference of the co-polarization and the cross-polarization. That is to say, when that ratio is 30 dB, the direction of the wave is on the circle including the point Q in FIG. 12A, thus, the zenith angle of the reception signal is obtained. Next, provided that the phase difference between the co-polarization and the cross-polarization is 90 degrees, the angle of the reception signal is on the line between $R_1$ and $R_2$ in FIG. 12B. In order to determine the point $R_1$ or $R_2$, an auxiliary antenna having the similar characteristics having a little different beam angle is utilized. By combining the two informations of the main antenna and the auxiliary antenna, the direction of the reception signal is detected, thus, a direction detector is possible without rotating mechanically an antenna.

From the foregoing, it will now be apparent that a new and improved antenna has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. An aperture antenna having at least a single primary radiator for radiating an electro-magnetic wave, and focusing means for focusing the radiated electromagnetic wave by the said primary radiator, wherein said focusing means is non-uniform in the circumferential direction such that the phase distribution of the electric field on an aperture plane of the antenna has the period of $\pi/2$ and the maximum phase deviation at $(2m-1)\pi/8$ from the orientation plane of one polarization where m is an integer.

2. An aperture antenna according to claim 1, wherein said focusing device is a deformed reflector.

3. An aperture antenna according to claim 2, wherein the reflector is axi-symmetrical, and the deformation of the reflector satisfies the formula;

$$\Delta Z(1-\cos\phi)=2r\cos(4\theta-\pi/2)$$

where $\Delta Z$ is the deformation between the actual plane of the reflector and the undeformed reflector on the point $(r,\theta,z)$ in the cylindrical coordinates system with the origin at the focus of the reflector and z-axis on the direction of the antenna beam, and $\phi$ is the angle between the z-axis and the line between the focal point of the antenna and the point $(r,\theta,z)$ on the reflection.

4. An aperture antenna according to claim 1, wherein said focusing device is an undeformed reflector with a dielectric structure on the surface of the reflector to provide said phase distribution.

5. An aperture antenna according to claim 4, wherein the reflector is axi-symmetrical and the thickness of the dielectric structure satisfies the formula:

$$\Delta t_1\left(\frac{\epsilon}{\sqrt{\epsilon-\sin^2\Phi}}+\frac{1}{\cos\Phi}\right)=r\cos\left(4\theta-\frac{\pi}{2}\right)$$

where $\Delta t_1$ is the deviation of the thickness of the dielectric structure on the point $(r,\theta,z)$ in the cylindrical coordinates system with the origin at the focus of the reflector and z-axis on the direction of the antenna beam, $\epsilon$ is the dielectric constant of the dielectric structure, and $\phi$ is the angle between the z-axis and the line between the focal point of the antenna and the point $(r,\theta,z)$.

6. An aperture antenna according to claim 1, wherein said focusing device is the combination of an undeformed reflector and a dielectric plate provided on the aperture plane of the antenna to provide said phase distribution.

7. An aperture antenna according to claim 6, wherein the thickness of the dielectric plate satisfies the formula;

$$\Delta t_2\left(\frac{1}{\sqrt{\epsilon}}-1\right)=r\cos\left(4\theta-\frac{\pi}{2}\right)$$

where $\Delta t_2$ is the deviation of the thickness of the dielectric plate on the point $(r,\theta,z)$ on an aperture plane in the cylindrical coordinates system, $\epsilon$ is the dielectric constant of the dielectric plane.

8. An aperture antenna according to claim 1, wherein said aperture antenna is an offset antenna.

9. An aperture antenna according to claim 1, wherein said aperture antenna is a dielectric lens antenna.

* * * * *